US005542955A

United States Patent [19]

Schrell et al.

[11] Patent Number: 5,542,955

[45] Date of Patent: Aug. 6, 1996

[54] DYEING MODIFIED VISCOSE FIBERS WITH ACID OR DIRECT DYES

[75] Inventors: Andreas Schrell; Andreas von der Eltz, both of Frankfurt, Germany

[73] Assignee: Hoechst Aktiengesellschaft, Germany

[21] Appl. No.: 538,503

[22] Filed: Sep. 29, 1995

[30] Foreign Application Priority Data

Oct. 4, 1994 [DE] Germany ..... 44 35 385.5

[51] Int. Cl.[6] ..... D06P 3/62; D06P 1/39; C08F 251/02

[52] U.S. Cl. ..... 8/561; 8/538; 8/921; 106/164; 106/162.6; 264/78; 264/194

[58] Field of Search ..... 8/538, 561, 921; 106/163.1–169; 264/78, 194

[56] References Cited

U.S. PATENT DOCUMENTS

| | | |
|---|---|---|
| 3,305,377 | 2/1967 | Mahomed . |
| 3,472,840 | 10/1969 | Stone et al. . |
| 3,793,419 | 2/1974 | Steinlin et al. . |
| 4,464,523 | 8/1984 | Neigel et al. . |
| 4,940,785 | 7/1990 | Stober et al. . |

FOREIGN PATENT DOCUMENTS

| | | |
|---|---|---|
| 2074747 | 2/1993 | Canada . |
| 310787 | 4/1989 | European Pat. Off. . |
| 1948487 | 4/1970 | Germany . |
| 1593657 | 10/1970 | Germany . |
| 1469062 | 8/1971 | Germany . |
| 4125752 | 2/1993 | Germany . |

OTHER PUBLICATIONS

CA abstract of JP 01020313 Jan. 1989.
CA abstract of JP 02274738 Nov. 1990.
CA abstract of JP 50040167 Dec. 1975.
CA abstract of JP 44002056 Dec. 1969.
CA abstract of JP 52121521 Oct. 1977.

*Primary Examiner*—Margaret Einsmann
*Attorney, Agent, or Firm*—Connolly & Hutz

[57] ABSTRACT

Process for dyeing regenerated cellulose fibers, which comprises adding an amine-substituted cellulose derivative to a viscose dope or to an alkali cellulose and spinning fibers by the viscose spinning process, or adding said cellulose derivative to a cellulose solution and spinning fibers from the solution, processing fibers into a woven or knitted fabric and dyeing the fabric with a direct or acid dye in the absence of additional electrolyte salt.

14 Claims, No Drawings

DYEING MODIFIED VISCOSE FIBERS WITH ACID OR DIRECT DYES

Viscose fibers have essentially the same dyeing characteristics as cotton fibers. At present, the dyeing of natural or regenerated cellulosic fibers requires alkali-donating agents and also electrolytes in order that satisfactory fixation results may be obtained with reactive dyes. It is precisely these necessary additions, however, which are ecologically unacceptable. The future will therefore increasingly belong to regenerated cellulose fibers which have been converted beforehand, without additional process steps, into modifications which have a high affinity for dyes, i.e. are dyeable without salt and alkali. Fibers modified in this way resemble animal fibers, such as wool or silk, in their chemical behavior and can be dyed with anionic dyes under neutral conditions without further salt or alkali additions.

Modifications of viscose have already been described in the literature. U.S. Pat. No. 3 793 419 describes a process for producing viscose fibers having novel dyeing characteristics. However, the process is extremely complicated and uneconomical. In addition, polyamineamides are used, which severely alter the native character of the fiber. This is evident for example from the use of disperse dyes in the later dyeing. Similarly, U.S. Pat. No. 3 305 377 concerns "aminalized fibers". The additions involved are aminoethyl- and diethylamino-celluloses in high concentrations, and dyeing is done exclusively with acid dyes and in the presence of additional electrolyte salt.

It has surprisingly been found that mixing an amine-substituted cellulose derivative into a viscose dope or alkalicellulose or into a cellulose solution makes it possible to produce a viscose fiber which can be dyed with direct dyes to an excellent quality even without the hitherto customary addition of electrolyte salt, but which hardly differs from the conventional viscose fibers in the other desired properties.

The present invention accordingly provides a process for dyeing regenerated cellulose fibers, which comprises adding an amine-substituted cellulose derivative to a viscose dope or to an alkali cellulose and spinning fibers by the viscose spinning process, or adding said cellulose derivative to a cellulose solution and spinning fibers from the solution, processing fibers into a woven or knitted fabric and dyeing the fabric with a direct or acid dye in the absence of additional electrolyte salt.

The synthesis of aminated cellulose derivatives has already been extensively described in the literature, for example in U.S. Pat. No. 3,472,840, European Patent Specification 0,310,787, U.S. Pat. No. 4,464,523 or CA-A-2 074 747.

Suitable amine-substituted cellulose derivatives are for example addition polymers of ethylenically unsaturated amines with cellulose. These polymers can be prepared by polymerization of A) monomers or monomer mixtures selected from the group consisting of a) N-vinylimidazoles, which can be substituted on the heterocycle ring by up to three $C_1$–$C_{12}$-alkyl radicals and can be present in N-quaternized form or in salt form, b) five- to eight-membered N-vinyllactams, which can be substituted on the ring by up to three $C_1$–$C_{12}$-alkyl radicals, c) dialkylaminoalkyl acrylates or methacrylates which can have in total up to 30 carbon atoms in the dialkylaminoalkyl radical and which can be present in N-quaternized form or in salt form, d) N-(dialkylaminoalkyl)-acrylamides or -methacrylamides which can have up to a total of 30 carbon atoms in the dialkylaminoalkyl radical and which can be present in N-quaternized form or in salt form, and e) diallyl-$C_1$–$C_{12}$-alkylamines or their salts or diallyldi($C_1$–$C_{12}$-alkyl)ammonium compounds, with or without as further comonomers for (A)

f) monoethylenically unsaturated $C_3$–$C_{10}$-carboxylic acids and their alkali metal, alkaline earth metal or ammonium salts, g) monoethylenically unsaturated $C_3$–$C_{10}$-carboxylic esters, and h) compounds which contain at least two ethylenically unsaturated, unconjugated double bonds in the molecule, and B) monosaccharides, oligosaccharides, polysaccharides, thermally or mechanically treated, oxidatively, hydrolytically or enzymatically degraded polysaccharides, oxidized hydrolyrically or enzymatically degraded polysaccharides, chemically modified mono-, oligo- and polysaccharides or mixtures thereof, in a weight ratio of (A):(B) of (95 to 20):(5 to 80).

It has proved advantageous in many cases to use polymers in which the monomers (A) are either compounds of (a), (c), (d) and (e) in each case alone or mixtures of 5 to 95% by weight of compound (b) and 95 to 5% by weight of one or more of the monomers (a), (c), (d), (e), (f), (g) and (h) , in which case (h) is present in an amount not greater than 5% by weight, based on the total amount of all monomers (A).

Good results are also obtained on using as amine-substituted cellulose derivatives addition polymers of N,N-diallyl-N,N-di($C_1$–$C_{12}$)alkylammonium halides and cellulose. Here it has proved advantageous to use N,N-diallyl-N-methyl-N-dodecylammonium halide, and N,N-diallyl-N-methyl-N-octylammonium halide, and N,N-diallyl-N-methyl-N-decylammoniuum halide, and N,N-diallyl-N,N-dimethylammonium halide, in particular N,N-diallyl-N,N-dimethylammonium chloride.

Good results are also obtained on preparing the amine-substituted cellulose derivative by reaction of the amines with cellulose, in which case the amines used can be compounds of the formula (1*a*) or (1*b*)

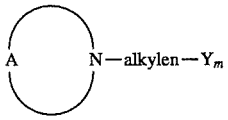

(1a)

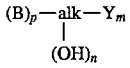

(1b)

where

Y is an ester group;

A and N together with 1 or 2 alkylene groups of 1 to 4 carbon atoms form the bivalent radical of a heterocyclic ring wherein A is an oxygen atom or a group of the formula (a), (b) or (c)

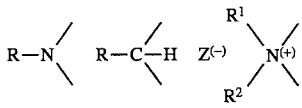

(a) (b) (c)

where

R is a hydrogen atom or an amino group or is an alkyl group of 1 to 6 carbon atoms which can be substituted by 1 or 2 substituents selected from the group consisting of amino, sulfo, hydroxyl, sulfato, phosphato and carboxyl, or is an alkyl group of 3 to 8 carbon atoms which is interrupted by 1 or 2 groups of the formulae —O— and —NH— and can be substituted by an amino, sulfo, hydroxyl, sulfato or carboxyl group, $R^1$ is hydrogen, methyl or ethyl, $R^2$ is hydrogen, methyl or ethyl, and $Z^{(-)}$ is anion;

B is the amino group of the formula $H_2N$— or an amino or ammonium group of the formula (d) or (e)

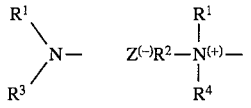

(d) (e)

where $R^1$, $R^2$ and $Z^{(-)}$ are each as defined above, $R^3$ is methyl or ethyl, and $R^4$ is hydrogen, methyl or ethyl;

p is 1 or 2;

alkylen is a straight-chain or branched alkylene radical of 2 to 6 carbon atoms which can be substituted by 1 or 2 hydroxyl groups or is a straight-chain or branched alkylene radical of 3 to 8 carbon atoms which is interrupted by 1 or 2 groups of the formulae —O— and —NH—;

alk is a straight-chain or branched alkylene radical of 2 to 6 carbon atoms or is a straight-chain or branched alkylene radical of 3 to 8 carbon atoms which is interrupted by 1 or 2 groups of the formulae —O— and —NH— and is preferably a straight-chain or branched alkylene radical of 2 to 6 carbon atoms;

m is 1 or 2;

n is from 1 to 4;

the amino, hydroxyl and ester groups can be attached equally to a primary, secondary or tertiary carbon atom of the alkylene radical.

Particularly suitable are amino-containing compounds in which the ester group is a sulfato or phosphato group or is $C_1$–$C_4$-alkanoyl, phenylsulfonyloxy or a phenylsulfonyloxy group substituted on the benzene ring by a substituent selected from the group consisting of carboxyl, $C_1$–$C_4$-alkyl, $C_1$–$C_4$-alkoxy and nitro.

Suitable amines for the purposes of the present invention can be selected in particular from the group consisting of N-(β-sulfato ethyl)piperazine, N-[β-(β'-sulfato-ethoxy) ethyl]piperazine, N-(γ-sulfato-β-hydroxypropyl)-piperidine, N-(γ-sulfato-β-hydroxypropyl)pyrrolidine, N-(β-sulfato-ethyl)piperidine, 2-sulfato-3-hydroxy-1-aminopropane, 3-sulfato-2-hydroxy-l-aminopropane, 1-sulfato-3-hydroxy-2-aminopropane, 3-hydroxy-1-sulfato-2-aminopropane, 2,3-disulfato-1-aminopropane, 1,3-disulfato-2-aminopropane, and a derivative of these compounds having instead of the sulfato group one of the aforementioned ester groups or N-(2-sulfatoethyl) piperazine sulfate.

In addition, the prefabricated celluloses can also be modified with compounds which have an α-chloro-β-hydroxyl or epoxy substituent as the reactive radical on the amino component. The term reactive further comprehends generally those moieties which are capable of reacting with hydroxyl groups, for example cellulose, or amino and thiol groups, for example of wool and silk, with the formation of a covalent chemical bond.

Suitable for use as the cellulose component for preparing the amine-substituted cellulose derivatives are carboxymethylcellulose, hydroxyethylcellulose, hydroxypropylcellulose, carboxymethylhydroxyethylcellulose, sulfoethylcellulose, carboxymethylsulfoethylcellulose, hydroxypropylsulfoethylcellulose, hydroxyethylsulfoethylcellulose, methylsulfoethylcellulose or ethylsulfoethylcellulose.

The process for preparing the aminated regenerated cellulose fibers is carried out either by alkalizing cellulose to form an alkali cellulose, react it with carbon disulfide and adding the amine-substituted cellulose derivatives to the viscose dope thus obtained, or by adding the amine-substituted cellulose derivatives directly to the alkali cellulose and then xanthating. Subsequent spinning in an acid spinbath affords the modified viscose fibers.

The nitrogen-containing compounds used for the present process are incorporated into the viscose dope in an aqueous medium or else advantageously by means of emulsifiers, and are highly compatible with the viscose. The amine-substituted cellulose derivative is added in an amount of 1 to 20%, preferably 1 to 12%, by weight, based on the cellulose content of the dope prior to coagulation and forming.

If the fibers of the present invention are produced by other customary processes for producing cellulosic fibers from solution with which the person skilled in the art is familiar, for example the cupro process, the Lyocell process or the process involving low-substituted cellulose ethers, then the cellulose is dissolved in a suitable organic solvent, reacted with the amine-substituted cellulose derivative and spun into fibers directly from the solution. The most favorable option is addition immediately prior to the spinning, in which case the mixing and homogeneous dispersion can be effected by means of known mixing systems with the aid of static or dynamic mixing systems. However, the addition can also take place at any desired preliminary stage of spinning dope production.

The aminated celluloses used as additions have degrees of polymerization between 300 and 1000 anhydroglucose units and viscosities of 300 to 1500 mPas. The degree of polymerization should not be less than 300, since otherwise there is a danger that the prefabricated aminated cellulose will be washed out of the fiber after spinning.

The prefabricated cellulose derivatives used for preparing the modified viscose, being soluble in water or aqueous alkali solution, are directly stirrable into the dope with good dispersion. No deterioration in the filterability of the viscose is observed compared with addition-free samples, so that no plugging of the spinneret is observed in the course of the spinning process. The forming of the viscose is carried out by customary and known methods, for example by means of spinnerets and a subsequent coagulation bath with or without further aftertreatment baths.

The textile modified fiber material which is used in the dyeing process of the present invention can be present in any state of processing, for instance yarn, staple, slubbing and piece goods (fabrics).

The modified textile fiber materials are dyed according to the present invention analogously to known processes for dyeing or printing fiber materials with direct or acid dyes using the temperature ranges and customary dyestuff quantities known for this purpose, except that the dyebaths, padding liquors, print pastes and inkjet formulations require no addition of electrolyte salts. Commercial direct dyes are normally used in the presence of salt contents or 0.01 to 0.5% by weight, based on the dyeing liquor. Without the novel modification to the cellulose fibers, this salt content would be too low by a factor of 50 to 1000 for a successful dyeing process.

Dyeing processes include for example the various exhaust processes, such as dyeing on the jigger and on the reel beck or the dyeing from long and short liquor, the dyeing in jet dyeing machines, the dyeing by short-time padbatch processes or by a pad-superheated steam fixation process. The dyeing processes which are usable according to the present invention also include the printing techniques, including inkjet printing and transfer printing.

The inkjet process is the only one of the non-contact printing processes to reproduce colored images quickly, quietly and in high resolution. Inkjet printing customarily involves an aqueous ink which is sprayed onto the substrate directly in small droplets.

Japanese Patent JP 86/226157 discloses coating the textile with a cationic polymer and then dyeing it with anionic dyes by the inkjet technique. However, this process prints with reactive dyes and uses alkali for achieving the actual fixation of the dye on the fiber.

The inkjet process is particularly highly suitable for printing modified viscose fibers with multicolor, crisp images and without effluent. Depending on the nature of the pretreatment, this takes place more or less quantitatively, so that even a subsequent wash can be dispensed with in most cases. In this way waste-free dyeing is achieved by printing.

The dyes which are used for dyeing the modified cellulose are direct and acid dyes.

Suitable acid and direct dyes for dyeing or printing cellulose fibers modified according to the present invention include for example the diamine dyes, ®Sirius Lightfast dyes, ®Alphanol dyes, ®Cotonerol dyes and ®Duasyn dyes, for example C. I. Acid Black 27 (C. I. No. 26 310), C. I. Acid Black 35 (C. I. No. 26 320), C. I. Acid Blue 113 (C. I. No. 26 360), C. I. Direct Orange 49 (C. I. No. 29 050) , C. I. Direct Orange 69 (C. I. No. 29 055) , C. I. Direct Yellow 34 (C. I. No. 29 060) , C. I. Direct Red 79 (C. I. No. 29 065), C. I. Direct Yellow 67 (C. I. No. 29 080), C. I. Direct Brown 126 (C. I. No. 29085) , C. I. Direct Red 84 (C. I. No. 35 760) , C. I. Direct Red 80 (C. I. No. 35 780), C. I. Direct Red 194 (C. I. No. 35 785), C. I. Direct Red 81 (C. I. No. 28 160), C. I. Direct Red 32 (C. I. No. 35 790) , C. I. Direct Blue 162 (C. I. No. 35 770), C. I. Direct Blue 159 (C. I. No. 35 775) , C. I. Direct Black 162: 1 and C. I. Direct Violet 9 (C. I. No. 27 885).

A direct dye ink formulation customary in inkjet printing preferably has the following composition:

| | |
|---|---|
| 5 to 10% by weight of | direct dye |
| 3 to 8% by weight of | a nonionic wetting agent (e.g. ®Genapol C, O, X, PF-grades) |
| 2 to 10% by weight of | diethylene glycol, propyleneglycol or similar glycols or glycol ethers |
| 0.1 to 5% by weight of | glycerol, di- or tetra-methylurea |
| 70 to 89.9% by weight of | distilled water. |

The examples which follow illustrate the process of the present invention. Unless otherwise stated, parts are by weight.

EXAMPLE 1

A plant-customary fiber grade viscose having a cellulose content of 8.9%, an alkali content of 5% and a viscosity of 38 falling-ball seconds at 30° C. is admixed with an N-(2-sulfatoethyl)piperazine-modified hydroxyethylcellulose (viscosity 925 mPas, DP about 700) as follows: 16.2 parts of the modified hydroxyethylcellulose are padded up with 49 parts of water and mixed with 436 parts of fiber grade viscose. This premix is stirred into 2522 parts of fiber grade viscose. After devolatilization, the dope is spun by plant-customary viscose spinning processes into a bath which contains sulfuric acid, sodium sulfate and zinc sulfate to form fibers, which are stretched in acid baths, cut, washed, spinfinished and dried. Weaving gives a textile viscose fabric which can be further processed directly in a dyeing process by the exhaust method. For this, 20 parts of the pretreated viscose fiber are treated in a dyeing apparatus with 200 parts of an aqueous liquor which, based on the weight of the dry fiber, contains 2% of the acid dye of the formula

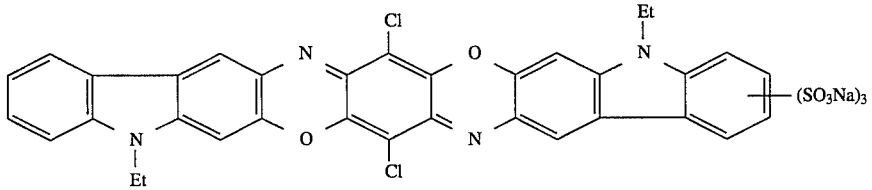

(C. I. Direct Blue 108, C. I. No. 51320) in solution. The liquor pH is first adjusted to 4.5 with acetic acid. The fiber is dyed for this liquor at 80° C. for 30 minutes. The dyeing thus produced is further treated by rinsing and soaping in a conventional manner. The result obtained is a deep blue dyeing having fastness properties which are far superior to those of conventional direct dyes. This is true in particular of the wash fastness properties.

EXAMPLE 2

A fiber grade viscose as described in Example 1 is admixed with a potato starch modified in accordance with the directions of Example 28 of CA-A-2 074 747.

Weaving gives a textile viscose fabric which can be further processed directly in a dyeing process by the padding method. For this, an aqueous dye solution which, per 1000 parts by volume, contains 20 parts of the acid of the formula

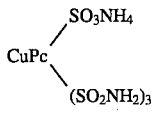

(Pc=phthalocyanine)

(C. I. Direct Blue 199) and 3 parts of a commercial nonionic wetting agent in solution, is padded at 25° C. onto the fabric using a pad-mangle at a wet pickup of 80%, based on the weight of the fabric. The dye solution had first been set to pH 5 with acetic acid. The fabric padded with the dye solution is then steamed for 2 minutes. The dyeing thus produced is further treated by rinsing and soaping in a conventional manner. The result is a deep turquoise dyeing having very good all round fastness properties.

EXAMPLE 3

A viscose modified as in Example 2 is passed by means of one or two rolls for guiding and tensioning the fabric underneath an inkjet printer and printed with aqueous solutions of direct dyes. To obtain multicolored prints, a four-color print is carried out with the primary colors of subtractive color mixing (yellow, cyan, magenta and black). The cyan dye used was C. I. Direct Blue 199, the yellow dye used was C. I. Direct Yellow 34 (C. I. No. 29060), the magenta dye used was C. I. Direct Red 79 (C. I. No. 29065) and the black component used was C. I. Direct Black 162:1. The printer works according to the drop on demand principle and the ink droplet is created thermally (bubble jet process). The printed fabric is subsequently steamed for 2 minutes and then conventionally rinsed and soaped. The resulting print has good all round fastness properties.

EXAMPLE 4

A fiber grade viscose as described in Example 1 is admixed with a cellulose, modified in accordance with the directions of Example I of U.S. Pat. No. 4,464,523, and having a nitrogen content of 2.9%, a viscosity of 825 mPas (2% strength solution in water) and a DP value of about 700, by following the directions of Example 1 of the present application.

A viscose thus modified is applied to a rotating roll. A continuous flow printing head then continuously emits droplets of direct dye which, under computer control, reach the viscose or are deflected. To obtain multicolored prints, a four-color print is carried out with the primary colors for subtractive color mixing (yellow, cyan, magenta and black). The cyan dye used is C. I. Direct Blue 199, the yellow dye used is C. I. Direct Yellow 34, the magenta dye used is C. I. Direct Red 81 and the black component used is C. I. Acid Black 35. The printed fabric is then steamed for 2 minutes and subsequently conventionally rinsed and soaped. The resulting print has good all round fastness properties.

EXAMPLE 5

A fabric grade viscose as described in Example 1 is admixed with a hydroxy cellulose modified in accordance with the directions of Example 2 of U.S. Pat. No. 3 472 840 by following the directions of Example 1 of the present application.

Further processing by the process steps customary for fabric grade viscose affords a fiber of modified viscose which is guided underneath an inkier printer by means of one or two rolls for guiding and tensioning the fabric and printed with aqueous solutions of direct dyes. The printer functions according to the drop on demand principle and the ink droplet is created by injection in the nozzle (pied principle). To obtain multicolor prints, a four-color print is carried out with the primary colors of subtractive color mixing (yellow, cyan, magenta and black). The cyan dye used is C. I. Direct Blue 199, the yellow dye used is C. I. Direct Yellow 67, the magenta dye used is C. I. Direct Red 81 and the black component used is C. I. Acid Black 27. The printed fabric is subsequently steamed for 2 minutes and then conventionally rinsed and soaped. The resulting print has good all round fastness properties.

Further Examples

The directions of Example 4 or 5 are followed and the modified viscose fiber is dyed in accordance with the directions of Example 1 with similar results using the below-listed dyes:

| | |
|---|---|
| C.I. Direct Violet 9 | C.I. No. 27885 |
| C.I. Direct Brown 126 | C.I. No. 29085 |
| C.I. Direct Orange 69 | C.I. No. 29055 |
| C.I. Acid Blue 113 | C.I. No. 26360 |
| C.I. Acid Blue 40 | C.I. No. 62125 |

What is claimed is:

1. A process for dyeing regenerated cellulose fibers, which comprises adding from 1 to 20% by weight based on the cellulose content of the dope of an amine-substituted cellulose derivative which is an addition polymer of ethylenically unsaturated amines with cellulose to a viscose dope or to an alkali cellulose and spinning fibers by the viscose spinning process, or adding said cellulose derivative to a cellulose solution and spinning fibers from the solution, subsequently processing fibers into a woven or knitted fabric and dyeing the fabric with a direct or acid dye without adding electrolyte salt.

2. The process of claim 1, wherein the amine-substituted cellulose derivatives are addition polymers of A) and B) in a weight ratio of (A):(B) of (95 to 20):(5 to 80), where A) comprises monomers or monomer mixtures selected from the group consisting of a) N-vinylimidazoles, which optionally are substituted on the heterocycle ring by up to three $C_1$–$C_{12}$-alkyl radicals and optionally are present in N-quaternized form or in salt form, b) five- to eight-membered N-vinyllactams, which optionally are substituted on the ring by up to three $C_1$–$C_{12}$-alkyl radicals, c) dialkylaminoalkyl acrylates or methacrylates which can have in total up to 30 carbon atoms in the dialkylaminoalkyl radical and which optionally are present in N-quaternized form or in salt form, d) N-(dialkylaminoalkyl)-acrylamides or -methacrylamides which can have up to a total of 30 carbon atoms in the dialkylaminoalkyl radical and which optionally are present in N-quaternized form or in salt form, and e) diallyl-$C_1$–$C_{12}$-alkylamines or their salts or diallyldi ($C_1$–$C_{12}$-alkyl) ammonium compounds, with or without as further comonomers for (A)

f) monoethylenically unsaturated $C_3$–$C_{10}$-carboxylic acids and their alkali metal, alkaline earth metal or ammonium salts, g) monoethylenically unsaturated $C_3$–$C_{10}$-carboxylic esters, and h) compounds which contain at least two ethylenically unsaturated, unconjugated double bonds in the molecule, and B) comprises monosaccharides, oligosaccharides, polysaccharides, thermally or mechanically treated, oxidatively, hydrolytically or enzymatically degraded polysaccharides, oxidized hydrolically or enzymatically degraded polysaccharides, chemically modified mono-, oligo- and polysaccharides or mixtures thereof.

3. The process of claim 2, wherein, in said polymers, the monomers (A) are either compounds of (a), (c), (d) and (e) in each case alone or mixtures of 5 to 95% by weight of compound (b) and 95 to 5% by weight of one or more of the compounds (a), (c), (d), (e), (f), (g) and (h), in which case (h) is present in an amount not greater than 5% by weight, based on the total amount of all comonomers (A) .

4. The process of claim 1, wherein the amine-substituted cellulose derivatives are addition polymers of N,N-diallyl-N,N-di($C_1$–$C_{12}$)-alkylammonium halides and cellulose.

5. The process of claim 4, wherein the N,N-diallyl-N,N-di ($C_1$–$C_{12}$) alkylammonium halides are N,N-diallyl-N-methyl-N-dodecylammonium halide, and N,N-diallyl-N-methyl-N-octylammonium halide, and N,N-diallyl-N-methyl-N-decylammonium halide, and N, N-diallyl-N,N-dimethylammonium halide.

6. A process for dyeing regenerated cellulose fibers, which comprises adding from 1 to 20% by weight based on the cellulose content of the dope, of an amine substituted cellulose derivative to a viscose spinning dope or to an alkali cellulose and spinning fibers by the viscose spinning process, or adding said cellulose derivative to a cellulose solution and spinning fibers from the solution, subsequently processing fibers into a woven or knitted fabric and dyeing the fabric with a direct or acid dye without adding electrolyte salt, wherein the amine-substituted cellulose-derivatives are reaction products of amines with cellulose, the amines being compounds of formula (1*a*) or (1*b*)

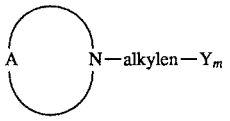

(1a)

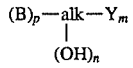

(1b)

where

Y is an ester group;

A and N together with 1 or 2 alkylene groups of 1 to 4 carbon atoms form the bivalent radical of a heterocyclic ring wherein A is an oxygen atom or a group of the formula (a), (b) or (c)

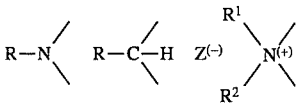

(a) (b) (c)

where

R is a hydrogen atom or an amino group or is an alkyl group of 1 to 6 carbon atoms which can be substituted by 1 or 2 substituents selected from the group consisting of amino, sulfo, hydroxyl, sulfato, phosphato and carboxyl, or is an alkyl group of 3 to 8 carbon atoms which is interrupted by 1 or 2 groups of the formulae —O— and —NH— and can be substituted by an amino, sulfo, hydroxyl, sulfato or carboxyl group, $R^1$ is hydrogen, methyl or ethyl, $R^2$ is hydrogen, methyl or ethyl, and $Z^{(-)}$ is anion;

B is the amino group of the formula $H_3N$— or an amino or ammonium group of the formula (d) or (e)

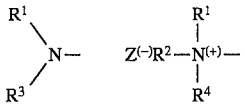

(d) (e)

where $R^1$, $R^2$ and $Z^{(-)}$ are each as defined above, $R^3$ is methyl or ethyl, and $R^4$ is hydrogen, methyl or ethyl;

alkylen is a straight-chain or branched alkylene radical of 2 to 6 carbon atoms which can be substituted by 1 or 2 hydroxyl groups or is a straight-chain or branched alkylene radical of 3 to 8 carbon atoms which is interrupted by 1 or 2 groups of the formulae —O— and —N'H—;

p is 1 or 2;

alk is a straight-chain or branched alkylene radical of 2 to 6 carbon atoms or is a straight-chain or branched alkylene radical of 3 to 8 carbon atoms which is interrupted by 1 or 2 groups of the formulae —O— and —N—;

m is 1 or 2;

n is from 1 to 4;

the amino, hydroxyl and ester groups can be attached equally to a primary, secondary or tertiary carbon atom of the alylene radical.

7. The process of claim 6, wherein the ester group Y is a sulfato or phosphato group or is $C_1$–$C_4$-alkanoyl, phenylsulfonyloxy or a phenylsulfonyloxy group substituted on the benzene ring by a substituent selected from the group consisting of carboxyl, $C_1$–$C_4$-alkyl, $C_1$–$C_4$-alkoxy and nitro.

8. The process of claim 6, wherein the amine is a compound selected from the group consisting of N-(β-sulfato-ethyl)piperazine, N-(2-sulfatoethyl)-piperazine sulfate, N-(β-(β'-sulfatoethoxy)ethyl]-piperazine, N-(γ-sulfato-β-hydroxypropyl)piperidine N-(γ-sulfato-β-hydroxypropyl)pyrrolidine, N-(β-sulfato-ethyl)piperidine, 2-sulfato-3-hydroxy-1-aminopropane, 3-sulfato-2-hydroxy-1-aminopropane, 1-sulfato-3-hydroxy-2-aminopropane, 3-hydroxy-1-sulfato-2-aminopropane, 2,3-disulfato-1-aminopropane, 1,3-disulfato-2-aminopropane, and a derivative of these compounds having instead of the sulfato group a phosphato group, a $C_1$–$C_4$-akanoyloxy group, an unsubstituted phenylsulfonyloxy group or a phenylsulfonyloxy group which is substituted on the benzene nucleus by substituents selected from the group consisting of carboxyl, $C_1$–$C_4$-alkyl, $C_1$–$C_4$-alkoxy and nitro.

9. The process of claim 6, wherein the amines contain a reactive moiety which can react with hydroxyl groups.

10. The process of claim 6, wherein the amines contain an α-chloro-β-hydroxy or epoxy substituent.

11. The process of claim 1, wherein the cellulose used for preparing the amine-substituted cellulose derivatives is a carboxymethylcellulose, hydroxymethylcellulose, hydroxypropylcellulose, carboxymethylhydroxyethylcellulose, sulfoethylcellulose, carboxymethylsulfoethylcellulose, hydroxypropylsulfoethylcellulose, hydroxyethylsulfoethylcellulose, methylsulfoethylcellulose or ethylsulfoethylcellulose.

12. The process of claim 1, wherein the amine-substituted cellulose derivatives have degrees of polymerization between 300 and 1000 anhydroglucose units and viscosities of 300 to 1500 mPas.

13. The process of claim 1, wherein the amine-substituted derivative is added in a concentration of 1 to 12% by weight, based on the cellulose content of the dope.

14. The process of claim 1, wherein the dyeing is carried out by an inkjet process.

* * * * *